US006210064B1

(12) United States Patent
White et al.

(10) Patent No.: US 6,210,064 B1
(45) Date of Patent: Apr. 3, 2001

(54) SOAP-FILLABLE BRUSH WITH SEALED ACTUATOR

(75) Inventors: Carly R. White; Dean Chapman, both of Brooklyn, NY (US)

(73) Assignee: General Housewares Corp., Elmira, NY (US)

( * ) Notice: Subject to any disclaimer, the term of this patent is extended or adjusted under 35 U.S.C. 154(b) by 0 days.

(21) Appl. No.: 09/221,489

(22) Filed: Dec. 28, 1998

(51) Int. Cl.[7] ..... A46B 11/04

(52) U.S. Cl. ..... 401/279

(58) Field of Search ..... 401/278, 279, 401/131, 282, 290

(56) References Cited

U.S. PATENT DOCUMENTS

| | | | | |
|---|---|---|---|---|
| Re. 33,860 | | 3/1992 | Chen . | |
| D. 310,601 | | 9/1990 | Byriel . | |
| D. 324,776 | | 3/1992 | Griffin et al. . | |
| D. 324,777 | | 3/1992 | Vangen . | |
| D. 334,665 | | 4/1993 | Johnson . | |
| 844,256 | | 2/1907 | Curcio . | |
| 893,635 | | 7/1908 | Marquart . | |
| 1,026,009 | | 5/1912 | Watanabe . | |
| 1,082,839 | | 12/1913 | Wurfschmidt . | |
| 1,138,772 | | 5/1915 | Matthews . | |
| 1,194,642 | * | 8/1916 | Kleeberg | 401/278 |
| 1,275,516 | | 8/1918 | Wren . | |
| 1,372,308 | | 3/1921 | MacRae . | |
| 1,577,192 | | 3/1926 | Rapisardi . | |
| 1,676,601 | | 7/1928 | Cavanaugh . | |
| 1,763,832 | | 6/1930 | Taylor . | |
| 1,810,544 | | 6/1931 | Trupiano . | |
| 1,862,430 | | 6/1932 | Robb . | |
| 1,939,516 | * | 12/1933 | Olson | 401/278 |
| 2,091,369 | | 8/1937 | LeMoine et al. . | |
| 2,103,493 | | 12/1937 | Robertson . | |
| 2,157,778 | * | 5/1939 | Tourot | 401/278 |
| 2,382,314 | * | 8/1945 | Herb | 401/278 |
| 2,493,990 | | 1/1950 | Morgadanes et al. . | |
| 2,636,203 | * | 4/1953 | Glantz | 401/278 |
| 2,764,772 | | 10/1956 | Staskowski et al. . | |
| 2,793,382 | | 5/1957 | Fletcher . | |
| 2,908,926 | | 10/1959 | Jockers . | |
| 2,920,333 | | 1/1960 | Montague et al. . | |
| 2,952,026 | * | 9/1960 | LaPland | 401/279 |
| 3,788,753 | | 1/1974 | Stewart . | |
| 4,066,367 | | 1/1978 | Sherosky . | |

(List continued on next page.)

FOREIGN PATENT DOCUMENTS

| | | | | |
|---|---|---|---|---|
| 1285109 | | 6/1991 | (CA) . | |
| 55068 | * | 2/1891 | (DE) | 401/278 |
| 3513730 | | 10/1986 | (DE) . | |

OTHER PUBLICATIONS

Photograph of Kellogg Brush.
Photograph of Acme International Inc. Brush (1994).
Photographs of Rite–Aid Soap–Fillable Brush Drawing No. 1384 of OXO Scrubbing Brush (1995).
Copy of Packaging Card for Phoenixware Brush (1991).

*Primary Examiner*—Charles R. Eloshway
(74) *Attorney, Agent, or Firm*—Seyfarth Shaw

(57) ABSTRACT

A fluid-containing brush has a housing with a generally cylindrical wall open at one end and closed at the other end by a base carrying the brush bristles. The housing defines a fluid reservoir and the base has a central opening therein closed by a valve member for dispensing liquid to the brush bristles. The valve is normally spring-biased closed and has a valve stem extending upwardly through the reservoir and having its upper end connected to an actuator button which is received in an opening in a cap removably attached to the housing. An elastomeric seal covers the cap and actuator button and seals the opening therebetween while permitting manual actuation of the button from above the cap to open the valve, the seal having a gasket lip portion engageable with the housing to provide a fluid-tight seal therebetween.

11 Claims, 4 Drawing Sheets

U.S. PATENT DOCUMENTS

| | | | | |
|---|---|---|---|---|
| 4,229,116 | | 10/1980 | Moore . | |
| 4,252,455 | | 2/1981 | de la Pena . | |
| 4,485,807 | | 12/1984 | Gueret . | |
| 4,580,587 | | 4/1986 | Rittich et al. . | |
| 4,753,547 | | 6/1988 | Dodero . | |
| 4,775,256 | | 10/1988 | Roth . | |
| 4,832,060 | | 5/1989 | Kingsford . | |
| 4,861,180 | | 8/1989 | Adams . | |
| 4,893,957 | | 1/1990 | Byriel . | |
| 4,955,746 | * | 9/1990 | Craigmile | 401/278 |
| 4,966,484 | | 10/1990 | Kimura . | |
| 5,017,036 | | 5/1991 | Vidovic . | |
| 5,088,849 | | 2/1992 | Johnson et al. . | |
| 5,103,560 | | 4/1992 | Podolsky . | |
| 5,133,130 | | 7/1992 | Podolsky . | |
| 5,251,752 | | 10/1993 | Purohit . | |
| 5,313,682 | | 5/1994 | Chamieh . | |
| 5,397,194 | | 3/1995 | Yuan et al. . | |

* cited by examiner

SOAP-FILLABLE BRUSH WITH SEALED ACTUATOR

BACKGROUND OF THE INVENTION

The present invention relates to cleaning devices and, in particular, to such devices which carry and dispense cleaning fluid. The invention relates in particular to a soap-dispensing brush.

Prior soap-dispensing cleaning devices are known, which include a housing defining a soap-containing reservoir, a wall of the housing carrying a cleaning medium, such as a sponge, brush or the like. A valve assembly dispenses fluid from the reservoir to the cleaning medium. In one such device the valve assembly includes a stem which extends upwardly through an opening in a cap which closes the upper end of the reservoir. The portion of the stem which extends upwardly through the cap defines a manually-actuated push button for opening the valve, which is spring-biased to a normally closed position. While such devices operate well in dispensing soap to the cleaning medium, they tend to leak cleaning fluid through the push button opening in the cap if the device is inverted or turned on its side, either in use or in storage or the like.

It is also known to provide cleaning devices with frictional gripping surfaces at hand-engaging portions.

SUMMARY OF THE INVENTION

It is a general object of the invention to provide an improved fluid-containing cleaning device which avoids the disadvantages of prior such devices while affording additional structural and operating advantages.

An important feature of the invention is the provision os a fluid-containing cleaning device of the type set forth, which has a manually-actuated, fluid-dispensing valve assembly which does not leak.

In connection with the foregoing feature, another feature of the invention is the provision of a device of the type set forth, which can be used or stored in any orientation without danger of leakage.

Still another feature of the invention is the provision of a device of the type set forth, which is of simple and economical construction.

Certain ones of these and other features of the invention may be attained by providing a fluid-containing cleaning device comprising: an open-top housing defining a fluid reservoir, a scrubbing medium carried by the housing, a valve carried by the housing for providing communication between the reservoir and the scrubbing medium and having a valve stem extending through the reservoir, a cap for closing the open top of the housing and having an opening therein for receiving the valve stem, and a flexible and resilient seal member covering the cap and providing a fluid-tight seal around the opening therein while accommodating manual actuation of the valve stem from above the cap.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
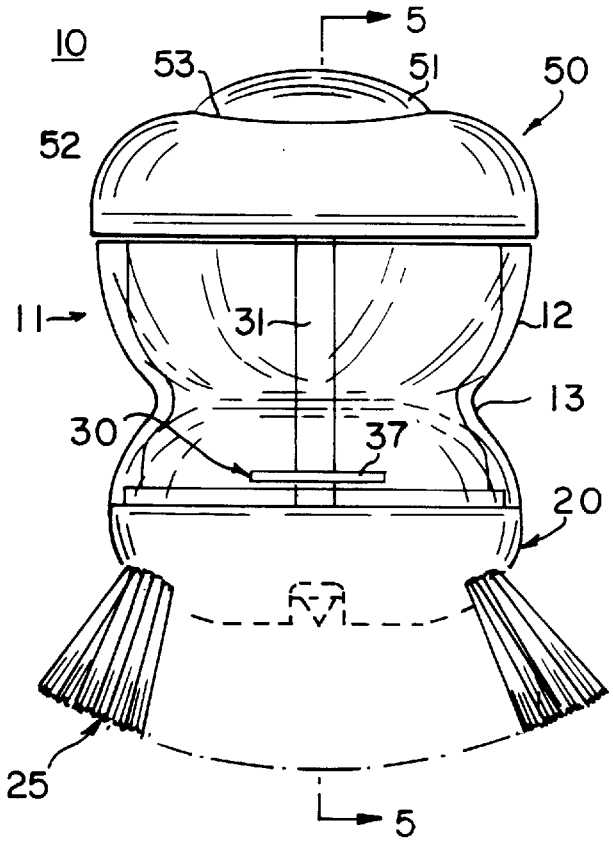
FIG. 1 is a front elevational view of a cleaning device in accordance with the present invention.
Figure 2:
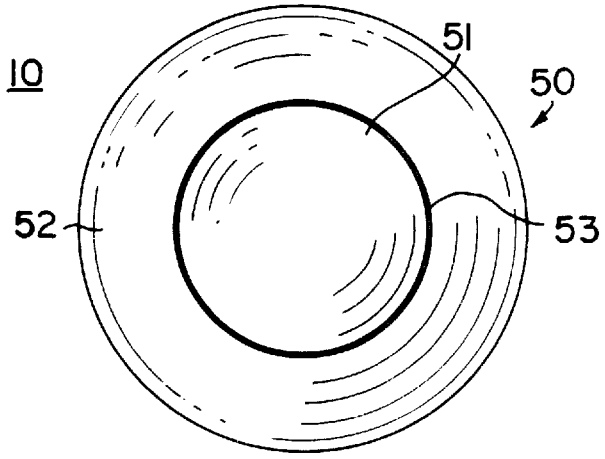
FIG. 2 is a top plan view of the cleaning device of FIG. 1.
Figure 3:
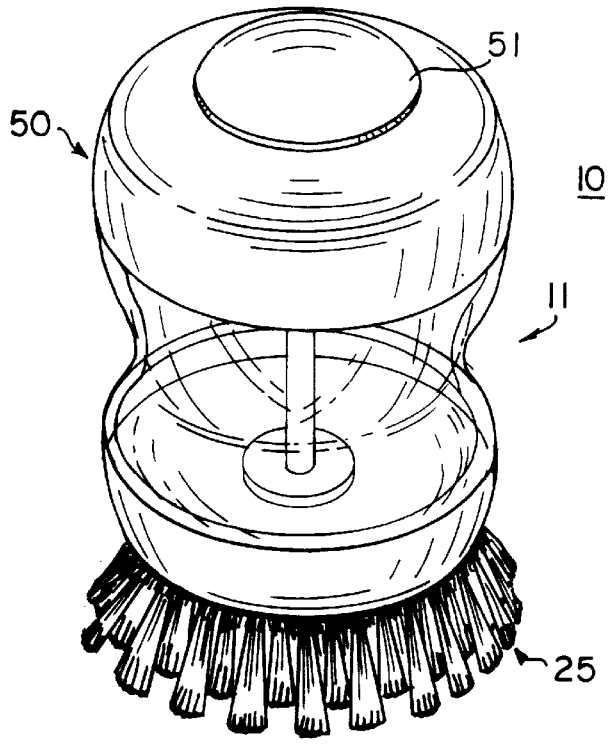
FIG. 3 is a front perspective view of the cleaning device of FIG. 1.
Figure 4:
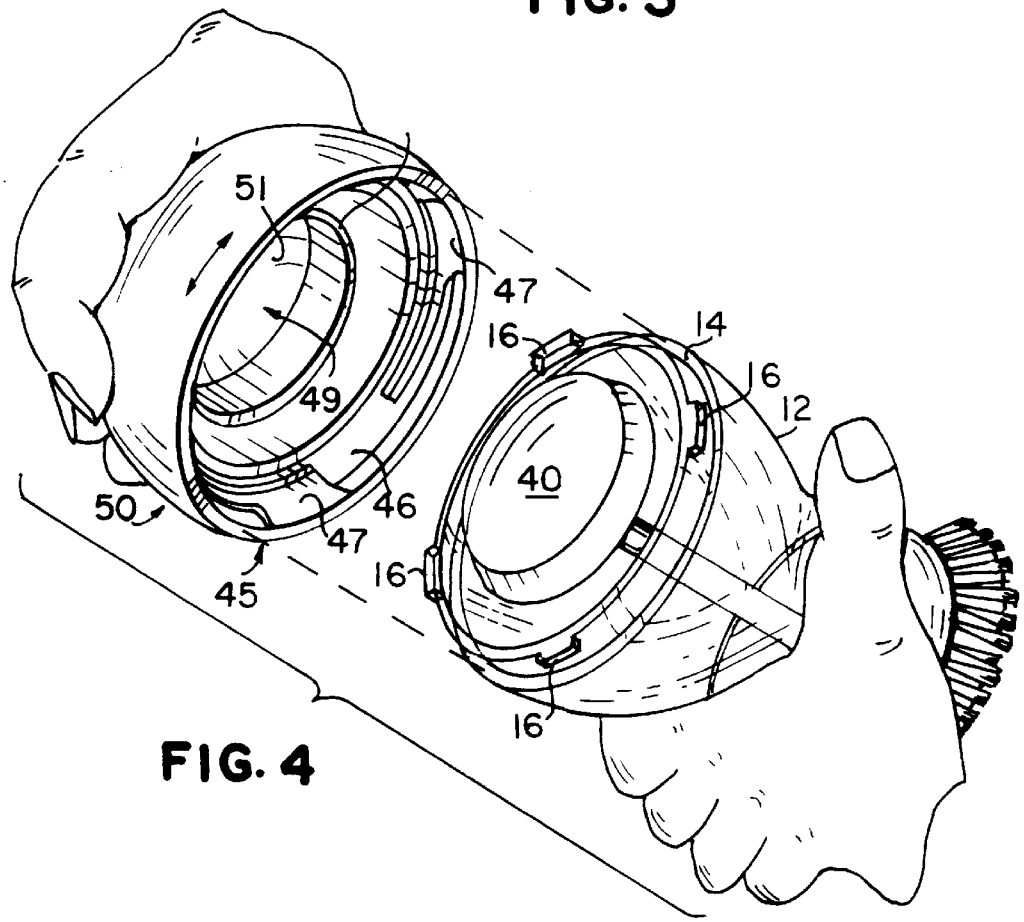
FIG. 4 is a perspective view illustrating opening of the cap of the cleaning device of FIG. 1.

Referring to FIGS. 1–4 and 7, there is illustrated a fluid-containing cleaning device, generally designated by the numeral 10, constructed in accordance with and embodying the features of the present invention. The cleaning device 10 is in the nature of a liquid soap-fillable brush, but it will be appreciated that the present invention is applicable to cleaning devices with other types of cleaning media, such as sponges or the line. The cleaning device 10 has a housing 11 which includes a generally cylindrical side wall 12, preferably formed of a transparent or translucent material, such as a suitable plastic. The side wall 12 has a radially inwardly projecting circumferential depression 13 formed therein intermediate the upper and lower ends thereof, which can serve as a finger grip to facilitate grasping of the device by a user. The side wall 12 is provided at its upper end with a circumferential groove 14, which defines an annular shoulder surface 14*a* and an annular lip 15 along the upper end edge. Four short rectangular lugs 16 project radially outwardly from the upper end of the lip 15 at equiangularly spaced locations. An annular groove 17 is formed in the lower end of the side wall 12 and is adapted to receive therein an annular flange 19 projecting axially from the annular end face 18 of a base wall 20, which may be formed of a suitable plastic material. The base wall 20 is fixedly secured to the side wall 12 for closing the lower end thereof by any suitable means, such as by ultrasonic welding.

The base wall 20 has an axial bore 21 formed therethrough (FIG. 7) which is provided with an enlarged-diameter counterbore 22 at its inner end and, at its outer end, with a counterbore 23 having a frustoconical inner end wall 24. Fixedly secured to the outer surface of the base wall 20 is a suitable cleaning medium 25 which, in the illustrated embodiment, comprises a plurality of brush bristles, which may be fixed in sockets 26 in the base wall 20 by any suitable means. It will be appreciated that the axial bore 21 provides communication between the interior of the housing 11 and the cleaning medium 25.

Figure 6:
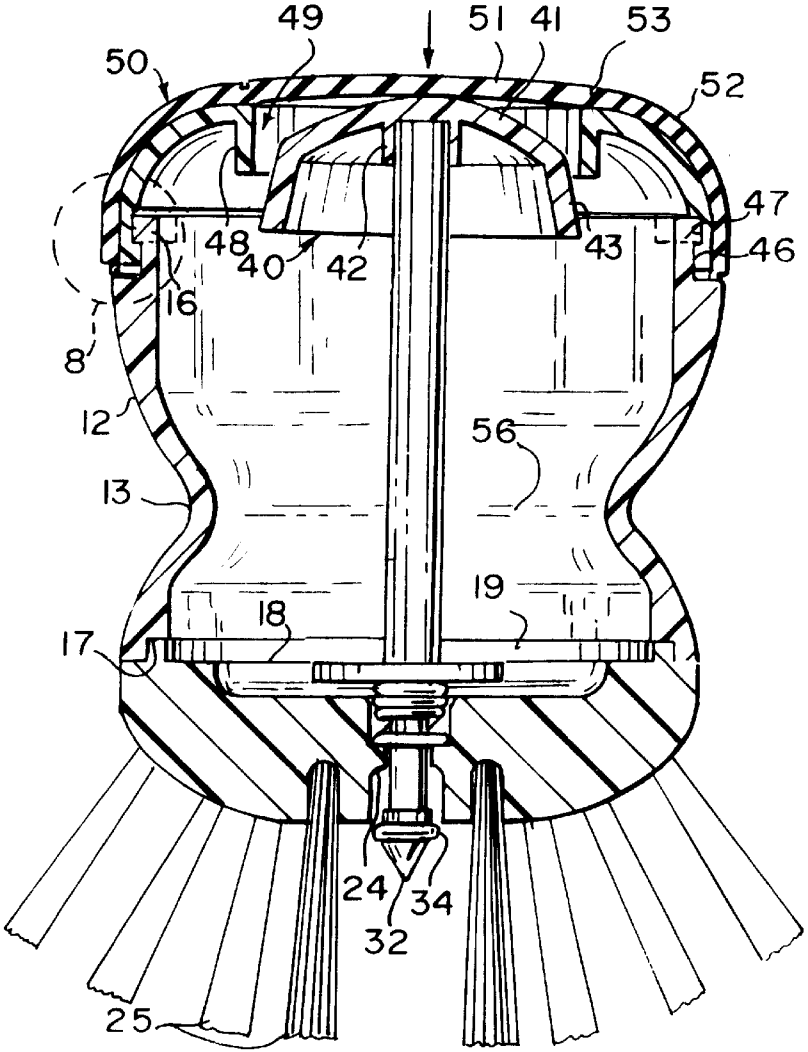
FIG. 6 is a view similar to FIG. 5, illustrating the valve assembly in its open condition.
Figure 5:
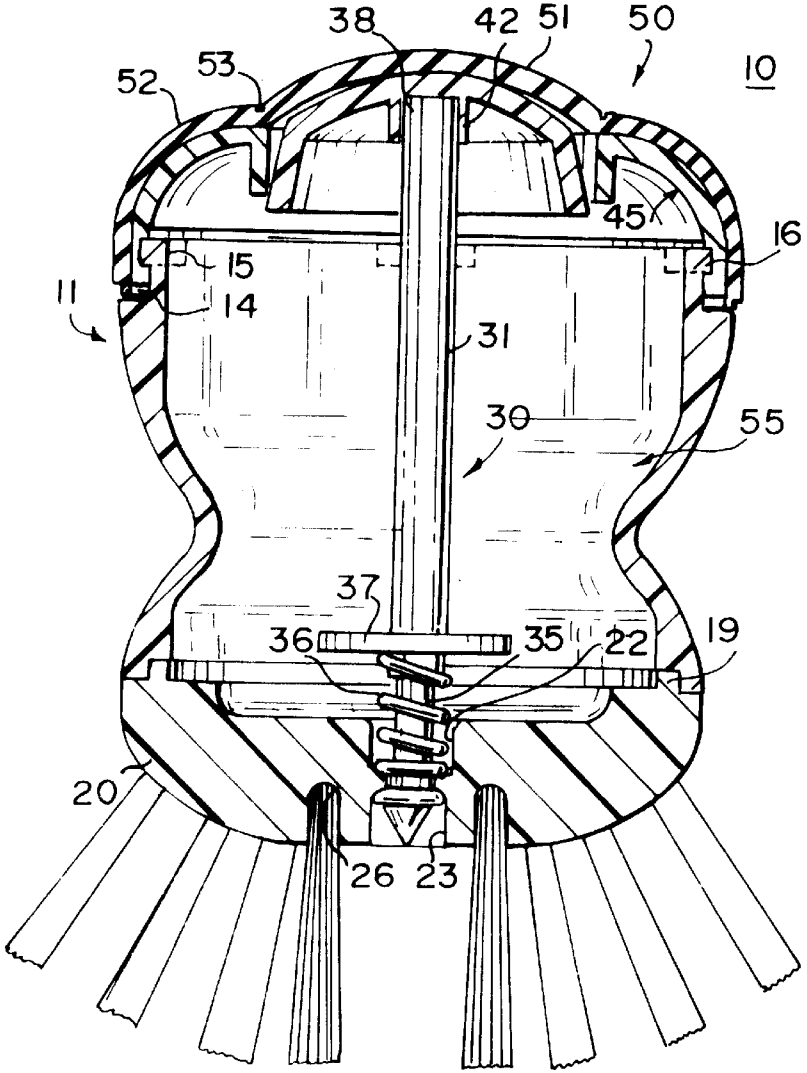
FIG. 5 is an enlarged view in vertical section taken along the line 5—5 in FIG. 1.
Figure 7:
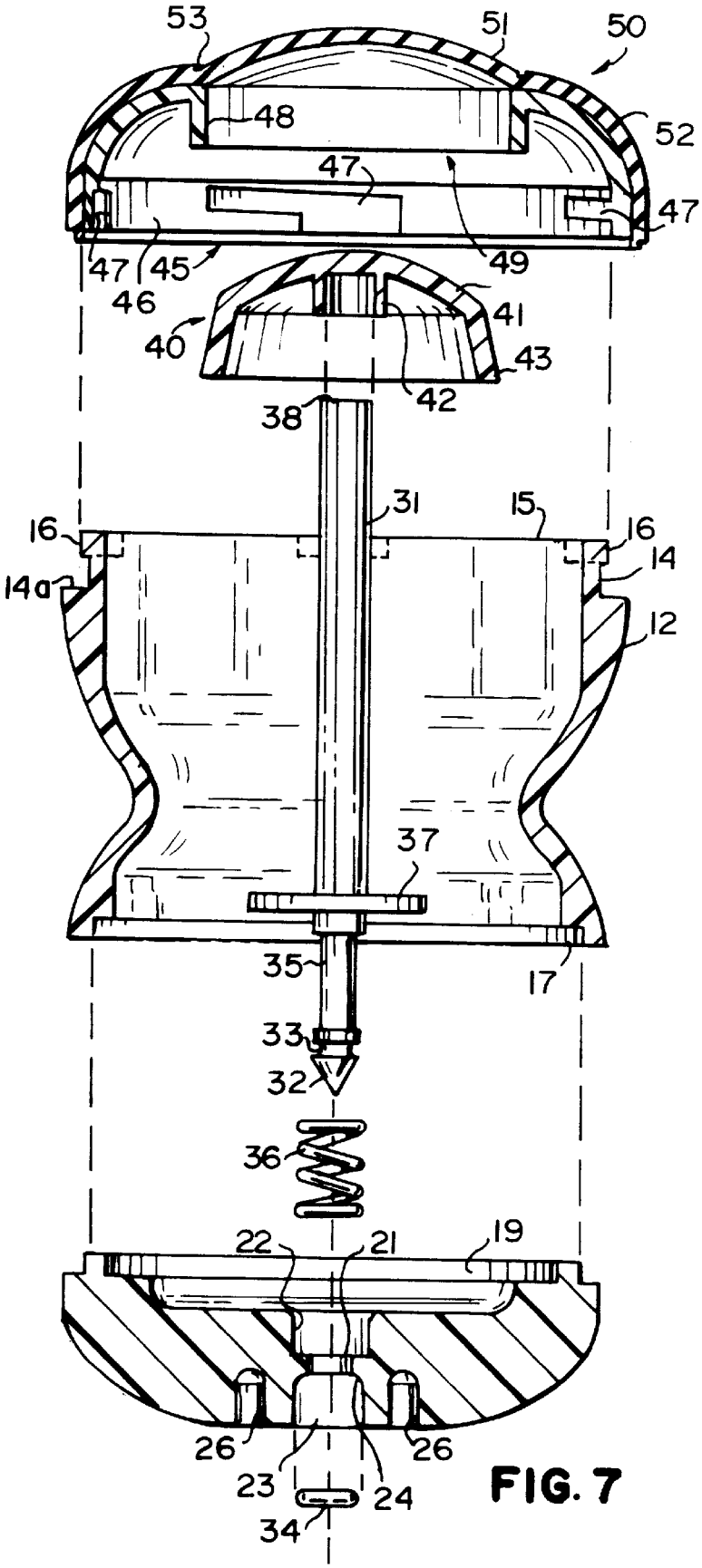
FIG. 7 is an enlarged, exploded, sectional view of the device of FIG. 1.

Referring in particular to FIGS. 5–7, the axial bore 21 is closeable by a valve assembly 30 which includes an elongated valve stem 31 extending axially through the housing 11 and through the axial bore 21, being provided at its distal end with a conical head 32. A valve member in the form of a flexible and resilient O-ring seal 34 is seated in a circumferential groove 33 in the stem 31 immediately above the head 32. The stem 31 preferably has a reduced-diameter neck portion 35 adjacent to the head 32, which is surrounded by a helical compression spring 36, one end of which is seated in the counterbore 23 and the other end of which is seated against a radially outwardly extending annular flange 37 on the stem 31.

The upper end 38 of the stem 31 is coupled to an actuator button 40. More specifically the button 40 has an arcuate head 41, which may be generally part-spherical in shape, and which is provided centrally of its inner surface with a depending cylindrical socket 42 which receive the upper end 38 of the stem 31 and may be fixed thereto by any suitable means. The head 41 of the actuator button 40 is provided around its periphery with a depending, generally frustoconical skirt 43.

In use, it will be appreciated that the spring 36 resiliently biases the valve assembly 30 to a normal closed condition, illustrated in FIG. 5, wherein the O-ring seal 34 seats against the wall 24 of the counterbore 23 and cooperates with the stem 31 to seal the opening defined by the axial bore 21. When the stem 31 is depressed by use of the actuator button 40, the O-ring seal 34 unseats, as illustrated in FIG. 6, permitting liquid soap or other fluid to flow through the axial bore 21 to the cleaning medium 25, the outward movement of the stem 31 being limited by engagement of the flange 37 with the inner surface of the housing base wall 20. Preferably, the stem 31 has a length such that, in its normal rest position illustrated in FIG. 5, the upper end 38 and the attached actuator button 40 project outwardly beyond the upper end of the side wall 12.

The device 10 also includes a cap 45 which is generally part-dome-shaped with a generally cylindrical skirt portion 46, which is provided adjacent to its distal edge with four equiangularly spaced, generally L-shaped recesses 47 in its inner surface. Disposed centrally of the cap 45 is an axially inwardly extending cylindrical neck 48 which defines a relatively large-diameter axial opening 49 through the cap 45, the opening 49 being dimensioned so as to receive the actuator button 40 therein. Preferably, the neck 48 is so dimensioned that, when the valve assembly 30 is in its normal rest condition, the frustoconical skirt 43 of the actuator button 40 engages the inner end of the neck 48 to close the opening 49, the actuator button 40 being shaped and dimensioned so that it projects axially outwardly beyond the outer surface of the cap 45, as can best be seen in FIG. 5, for easy actuation by the fingers or palm of the user's hand to open the valve assembly 30.

Figure 8:
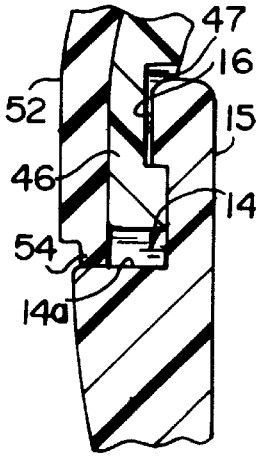
FIG. 8 is a further enlarged, fragmentary view of a portion of the cleaning device of FIG. 6.

While the skirt 43 of the actuator button 40 preferably engages the neck 48, it does not provide a fluid-tight seal therewith, Thus, it is a significant aspect of the present invention that there is also provided a flexible and resilient cover or seal member 50, which covers the entire outer surface of the cap 45, including the opening 49. The cover 50 is preferably formed of a suitable elastomeric material and is fixedly secured to the outer surface of the cap 45 by any suitable means, such as insert molding. The cover 50 is preferably molded with a central dome 51 and an arcuate annular skirt portion 52 with a circular groove 53 formed therebetween in the outer surface of the cover 50 to facilitate flexing of the dome 51 relative to the skirt portion 52. Referring also to FIG. 8, the skirt portion 52 extends beyond the lower edge of the cap skirt portion 46 and is of reduced thickness to define an annular gasket lip 54.

It can be seen that the cover 50 completely covers the actuator button 40 and the opening 49 in which the actuator button 40 is disposed, thereby effectively preventing the escape of fluid through the opening 49. Furthermore, the cover 50 which may be formed of an elastomeric material, such as that sold under the trademark "SANTOPRENE", also provides a frictional non-slip surface to improve the grip by a user's hand.

In use, the cap 45 is fitted onto the upper end of the housing 11, with the lugs 16 received in the recesses 47, the L-shape of which accommodates a slight rotation of the cap 45 relative to the side wall 12 in a known manner, to securely hold the cap 45 in place for cooperation with the housing 11 to define and close a fluid reservoir 55, which is fillable with a suitable cleaning fluid, such as a liquid soap 56. It will be appreciated that the cap 45 could also be removably attached to the housing 11 by other means, such as a threaded coupling. The flexible and resilient nature of the dome 51 of the cover 50 accommodates easy actuation of the actuator button 40 from above the cap 45, as illustrated in FIGS. 5 and 6, while maintaining an effective seal of the opening 49. When the cap 45 is secured in place, the cover gasket lip 54 engages the shoulder surface 14*a* (FIG. 8) to form a fluid-tight seal between the cap 45 and the housing 11.

From the foregoing, it can be seen that there has been provided an improved fluid-containing cleaning device which is refillable with and dispenses a suitable cleaning fluid, without risk of leakage in use.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A fluid-containing cleaning device comprising:

a housing defining a fluid reservoir and atop opening and having a central axis, a scrubbing medium carried by the housing, a valve carried by the housing for providing communication between the reservoir and the scrubbing medium and having a valve stem extending through the reservoir, an enlarged actuator member connected to said valve stem and having a maximum lateral extent substantially greater than that of the stem, a cap forming atop wall of the housing and extending transversely of the axis for closing the top opening of the housing and defining an enlarged cap opening therein for receiving the actuator member, the cap opening having a transverse cross-sectional area substantially smaller than that of the top opening and having a lateral extent greater than maximum lateral extent of the actuator member, and a flexible and resilient member covering the actuator member and closing the cap opening while accommodating manual actuation of the actuator member from above the cap.

2. The cleaning device of claim 1, wherein said flexible and resilient member is fixed to said cap.

3. The cleaning device of claim 1, wherein said valve includes a bias spring disposed between said valve stem and said housing and resiliently urging said valve stem to a normal closed position of the valve, said valve stem being manually movable against the urging of said bias spring to an open position accommodating flow of fluid from the reservoir to the scrubbing medium.

4. The cleaning device of 1, wherein said housing is formed of a light-transmitting material.

5. The cleaning device of claim 1, wherein said actuator member is generally in the shape of an inverted cup.

6. The cleaning device of claim 1, wherein said actuator member includes a socket for receiving a free distal end of the valve stem.

7. The cleaning device of claim 1, wherein said housing includes a base wall on which said scrubbing medium is carried and having an aperture therein, said valve being movable between open and closed positions relative to said aperture.

8. The cleaning device of claim 7, wherein said valve stem extends through said aperture, and further comprising a valve member carried by said valve stem and cooperating therewith to close said aperture in the closed position of said valve.

9. The cleaning device of claim 8, wherein said valve member includes an O-ring formed of flexible and resilient material and encircling said valve stem.

10. The cleaning device of claim 7, wherein said valve further includes a bias spring disposed between said valve stem and said base wall and resiliently urging said valve to its closed position.

11. The cleaning device of claim 1, and further comprising a gasket portion of the flexible and resilient member providing a fluid-tight seal between the cap and the housing.

* * * * *

UNITED STATES PATENT AND TRADEMARK OFFICE

CERTIFICATE OF CORRECTION

PATENT NO. : 6,210,064 B1
DATED : April 3, 2001
INVENTOR(S) : White et al.

It is certified that error appears in the above-identified patent and that said Letters Patent is hereby corrected as shown below:

Column 6,
Immediately after claim 11, insert the following:

-- 12. The cleaning device of claim 1, wherein said scrubbing medium includes brush bristles. --

-- 13. The cleaning device of claim 1, wherein said housing is substantially cylindrical in shape. --

-- 14. The cleaning device of claim 13, wherein said housing is formed of a plastic material. --

-- 15. The cleaning device of claim 13, wherein said housing has a laterally inwardly extending recess extending circumferentially therearound. --

-- 16. The cleaning device of claim 1, wherein said cap is removably attached to said housing. --

Signed and Sealed this

Eighteenth Day of December, 2001

*Attest:*

*Attesting Officer*

JAMES E. ROGAN
*Director of the United States Patent and Trademark Office*

US006210064C1

(12) EX PARTE REEXAMINATION CERTIFICATE (8355th)

United States Patent
White et al.

(10) Number: US 6,210,064 C1
(45) Certificate Issued: Jun. 28, 2011

(54) SOAP-FILLABLE BRUSH WITH SEALED ACTUATOR

(75) Inventors: Carly R. White, Brooklyn, NY (US); Dean Chapman, Brooklyn, NY (US)

(73) Assignees: WKI Latin America Holding, LLC, Reston, VA (US); WKI Holding Company, Inc., Reston, VA (US); World Kitchen, Inc., Reston, VA (US); Ekco Group, LLC, Reston, VA (US); World Kitchen (GHC), LLC, Reston, VA (US); Ekco Housewares, Inc., Reston, VA (US); Ekco Manufacturing of Ohio, Inc., Reston, VA (US)

Reexamination Request:
No. 90/009,627, Oct. 28, 2009

Reexamination Certificate for:

| | |
|---|---|
| Patent No.: | **6,210,064** |
| Issued: | **Apr. 3, 2001** |
| Appl. No.: | **09/221,489** |
| Filed: | **Dec. 28, 1998** |

Certificate of Correction issued Dec. 18, 2001.

(51) Int. Cl.
*A46B 11/04* (2006.01)

(52) U.S. Cl. ..... 401/279

(58) Field of Classification Search ..... None
See application file for complete search history.

(56) References Cited

U.S. PATENT DOCUMENTS

| | | | | |
|---|---|---|---|---|
| 1,939,516 | A | | 12/1933 | Olson |
| 2,091,369 | A | * | 8/1937 | Le Moine et al. ..... 401/273 |
| 2,157,778 | A | | 5/1939 | Tourot |
| 2,382,314 | A | * | 8/1945 | Herb ..... 401/150 |
| 2,521,882 | A | | 1/1947 | Swift et al. |
| 4,955,746 | A | | 9/1990 | Craigmile |

* cited by examiner

*Primary Examiner*—Aaron J. Lewis

(57) ABSTRACT

A fluid-containing brush has a housing with a generally cylindrical wall open at one end and closed at the other end by a base carrying the brush bristles.The housing defines a fluid reservoir and the base has a central opening therein closed by a valve member for dispensing liquid to the brush bristles. The valve is normally spring-biased closed and has a valve stem extending upwardly through the reservoir and having its upper end connected to an actuator button which is received in an opening in a cap removably attached to the housing. An elastomeric seal covers the cap and actuator button and seals the opening therebetween while permitting manual actuation of the button from above the cap to open the valve, the seal having a gasket lip portion engageable with the housing to provide a fluid-tight seal therebetween.

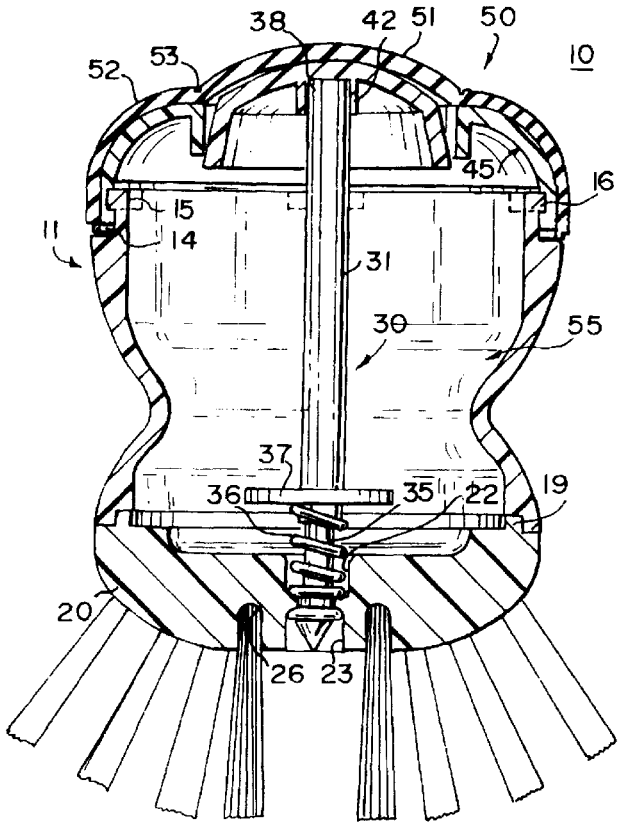

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 11 is cancelled.

Claim 1 is determined to be patentable as amended.

Claims 2-10 dependent on an amended claim are determined to be patentable.

Claims 12-16 were not reexamined.

1. A fluid-containing cleaning device comprising:

a housing defining a fluid reservoir and a top opening and having a central axis, a scrubbing medium carried by the housing, a valve carried by the housing for providing communication between the reservoir and the scrubbing medium and having a valve stem extending through the reservoir, an enlarged actuator member connected to said valve stem and having a maximum lateral extent substantially greater that that of the stem, a cap forming atop wall of the housing and extending transversely of the axis for closing the top opening of the housing and defining an enlarged cap opening therein for receiving the actuator member, the cap opening having a transverse cross-sectional area substantially smaller than that of the top opening and having a lateral extent greater than *the* maximum lateral extent of the actuator member, [and]

a flexible and resilient member covering the actuator member and closing the cap opening while accommodating manual actuation of the actuator member from above the cap*; and*

*a gasket portion providing a fluid-tight seal between the cap and the housing, the gasket portion forming a part of and extending from the flexible and resilient member*.

* * * * *